US007172127B1

(12) United States Patent
Poland

(10) Patent No.: US 7,172,127 B1
(45) Date of Patent: Feb. 6, 2007

(54) SLEEVE FOR USE WITH STORE DISCOUNT CARDS

(76) Inventor: Mark A. Poland, 23 Ward Ave., Butler, NJ (US) 07405

( * ) Notice: Subject to any disclaimer, the term of this patent is extended or adjusted under 35 U.S.C. 154(b) by 0 days.

(21) Appl. No.: 10/947,904

(22) Filed: Sep. 22, 2004

Related U.S. Application Data

(60) Provisional application No. 60/504,600, filed on Sep. 22, 2003.

(51) Int. Cl.
*G06K 7/00* (2006.01)

(52) U.S. Cl. ..... 235/486

(58) Field of Classification Search ..... 235/486; 362/154; 40/661.12; 206/38, 39.5, 39, 449; 283/62
See application file for complete search history.

(56) References Cited

U.S. PATENT DOCUMENTS

| | | | | |
|---|---|---|---|---|
| 3,242,959 | A * | 3/1966 | Glass | 206/37 |
| 4,674,628 | A | 6/1987 | Prinsloo et al. | 206/38.1 |
| 4,700,840 | A * | 10/1987 | Haddock | 206/449 |
| 5,038,926 | A | 8/1991 | van der Toorn | 206/39.3 |
| 5,080,223 | A * | 1/1992 | Mitsuyama | 206/39.5 |
| 5,506,395 | A | 4/1996 | Eppley | 235/486 |
| 5,941,375 | A * | 8/1999 | Kamens et al. | 206/38 |
| 6,076,296 | A * | 6/2000 | Schaeffer | 40/661.12 |
| 6,409,360 | B2 * | 6/2002 | Contant et al. | 362/154 |
| 6,715,795 | B2 * | 4/2004 | Klure | 283/62 |
| 2005/0011776 | A1 * | 1/2005 | Nagel | 206/39 |

OTHER PUBLICATIONS

Consumer Reports, Oct. 2003, vol. 68, No. 10, p. 6 "Are you losing money on discount cards?".

* cited by examiner

*Primary Examiner*—Ahshik Kim
*Assistant Examiner*—Tae W. Kim
(74) *Attorney, Agent, or Firm*—William E. Hein

(57) ABSTRACT

A plastic sleeve for enveloping a store discount card of the type displaying a machine readable code, such as a bar code, on one surface thereof and typically retained on a user's keychain, from being inadvertently scanned by a bar code reader at the checkout counter of a store.

17 Claims, 2 Drawing Sheets

SLEEVE FOR USE WITH STORE DISCOUNT CARDS

REFERENCE TO RELATED APPLICATION

This application is related to and claims the benefit under 35 U.S.C. 119(e) of U.S. provisional Patent Application Ser. No. 60/504,600 filed Sep. 22, 2003.

BACKGROUND AND SUMMARY OF THE INVENTION

This invention relates generally to store discount cards like those typically provided by supermarkets to their customers and, more particularly, to a sleeve for containing such a card so that the bar code displayed thereon will not be inadvertently read by the bar code reader at the store's checkout counter.

Store discount cards or tabs typically display a bar code on one surface and the store or supermarket chain insignia on the opposite surface. Many shoppers carry two or more of these cards from different issuing stores attached to a keychain. This practice can very easily result in the wrong card being read at the checkout counter of a store, thus denying the customer the discount and/or bonus points to which he or she is entitled. The problem encountered by customers who carry multiple discount cards on a keychain or some other common attachment device is discussed in a recent magazine article entitled "Are you losing money on discount cards?" (Consumer Reports, October, 2003, vol. 68, no. 10, p. 6). This publication suggests that the consumer carry discount cards in a wallet rather than on a keychain. Following this suggestion results in the time consuming task of sorting through various credit cards, discount cards, identification cards, etc. that a person usually carries in a wallet, identifying the needed discount card, and then separately presenting it to the cashier. Another suggestion for those who carry multiple discount cards on a keychain is to identify the required card, remove it from the keychain, and then present the card to the cashier. Both of these suggested solutions to the problem are cumbersome, time consuming, and, in the case of the latter suggestion in which the customer removes the desired card from his or her keychain, may very easily result in the consumer's keys being scattered on the floor or checkout counter in the removal process.

U.S. Pat. No. 4,674,628 to Prinsloo et al. describes a credit card holder having but one open end through which all of the cards are inserted or removed. Once removed, each card is free from attachment to the holder, thus rendering it susceptible to misplacement or loss.

U.S. Pat. No. 5,038,926 to van der Toorn describes a credit card holder having a plurality of rigid four-legged planar frames into which cards of only a single size are inserted and retained by clicking them into place. The rigid frames are pivotally connected in a parallel planar formation so that they may be viewed by pivotally opening the holder in the manner of a fan. Top and bottom lids of the holder are similarly pivotally connected to the plurality of rigid frames.

U.S. Pat. No. 5,080,223 to Mitsuyama describes a credit card holder having a plurality of pockets open at only one end to permit insertion and removal of cards. An elongated finger tip opening on one or both of the two sheets that make up each pocket facilitates complete removal of the card stored therein that is required in order to scan the card.

U.S. Pat. No. 5,506,395 to Eppley describes a booklike holder arrangement of transparent pockets, not all the same size, for retaining credit cards and a multi-access card upon which a plurality of machine readable codes are reproduced. The pockets are open only at one end at which cards are inserted or removed. At least one of the pockets has a machine readable code reproduced on the pocket itself.

It would therefore be advantageous to provide, in accordance with the illustrated embodiments of the present invention, a sleeve or sleeve packet for enveloping one or more store discount cards of the type displaying a bar code on one surface thereof and typically retained on a user's keychain, from being inadvertently scanned by a bar code reader at the checkout counter of a store or supermarket.

DETAILED DESCRIPTION OF THE PREFERRED EMBODIMENTS

Figure 1A:
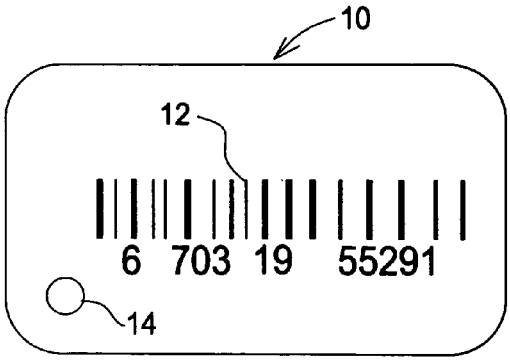
FIG. 1A is a plan view of a typical store discount tab or card illustrating a bar code on a surface thereof.
Figure 1B:
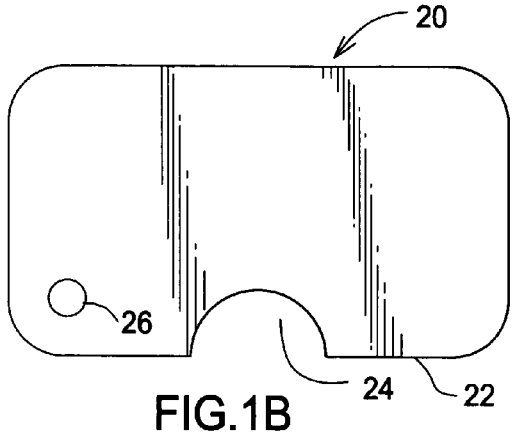
FIG. 1B is a plan view of a sleeve, constructed in accordance with the present invention, for enveloping the store discount card of FIG. 1A.

Referring now to FIG. 1A, there is shown a typical store discount card 10 having a bar code 12 printed or otherwise displayed on one surface thereof. The opposite surface of the card 10 typically displays the issuing store or super market chain's indentifying insignia. A keychain hole 14 is provided at a desired position on card 10. A sleeve 20, illustrated in FIG. 1B, is adapted to receive and envelope a single card 10 and is formed to be open along the periphery thereof, except at a fold edge 22. A generally semicircular opening 24 is formed along fold edge 22 of sleeve 20. A hole 26 is provided in sleeve 20 so that when card 10 is enveloped in sleeve 20, hole 26 is in general alignment with hole 14 on card 10 so that the user's keychain or other common attachment device can pass through both card 10 and sleeve 20. Sleeve 20 is preferably fabricated of a translucent plastic material that is sufficiently obscure to prevent the bar code 12 from being read through the sleeve but that is sufficiently clear to allow the identifying insignia on the opposite surface of card 10 to be recognized by the user.

When the user is ready to present a particular card 10 for scanning at the checkout counter of a store, he or she identifies the sleeved card 10 from among several sleeved cards that may be retained on his or her keychain and then pushes the identified card 10 at the semicircular opening 24 of its sleeve 20 to permit partial removal of card 10. Even during scanning, card 10 remains attached to its sleeve 10 by means of the user's keychain or other attachment device.

Figure 2B:
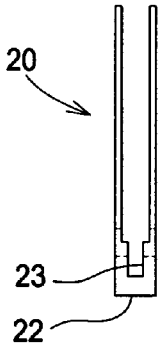
FIGS. 2A–B are a plan view of the sleeve of FIG. 1B and a side view of one embodiment thereof, including a narrowed bottom portion thereof, for more securely enveloping the card of FIG. 1A therein.
Figure 2A:
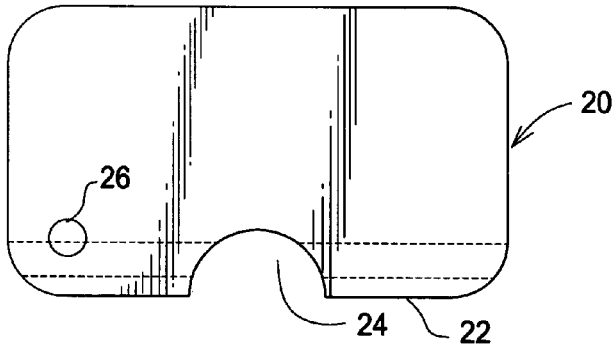
Figure 3A:
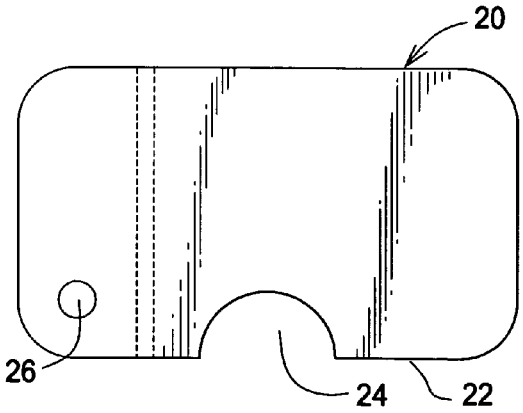
FIGS. 3A–B are a plan view of another embodiment of the sleeve of FIG. 1B and a cross-sectional top view thereof showing a pair of facing protrusions formed on inner surfaces of the sleeve for more securely enveloping the card of FIG. 1A therein.
Figure 3B:
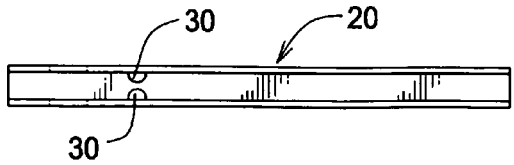

Referring now to FIGS. 2A–B, there is shown an embodiment of sleeve 20 in which its fold edge 22 includes an interior narrowed slot 23 for more securely retaining a card 10 therein until removal for scanning purposes is desired. Alternatively, a pair of facing protrusions 30 formed on the inner surfaces of sleeve 20, as illustrated in FIGS. 3A–B, may be provided to serve the same purpose.

Figure 4A:
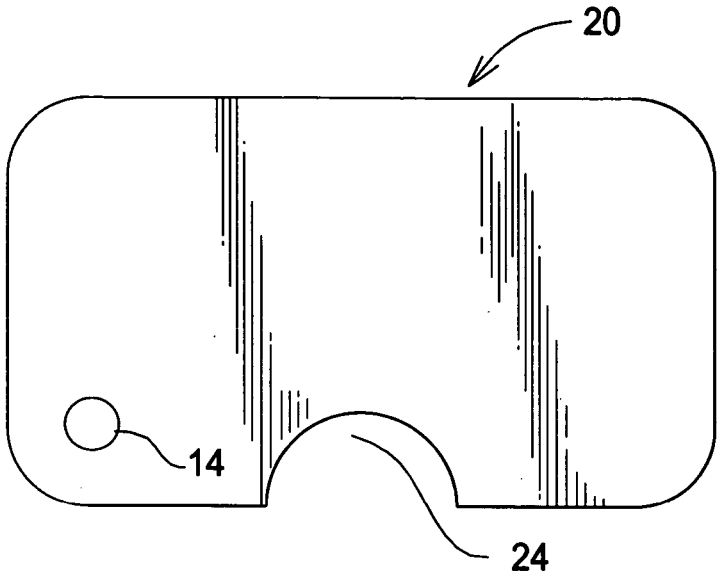
FIGS. 4A–B are a plan view and side view of another embodiment of the present invention in which a plurality of card sleeves like that of FIG. 1B are assembled to form a unitary sleeve packet that includes a plurality of card slots for enveloping a corresponding plurality of cards.
Figure 4B:
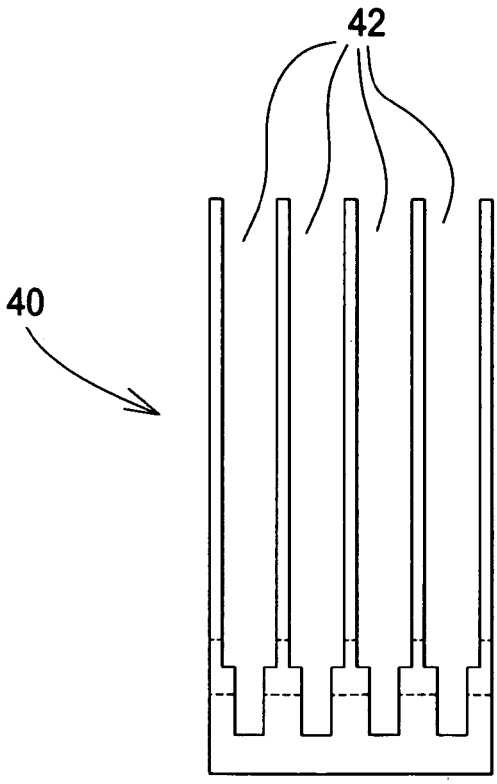

Referring now to FIGS. 4A–B, there is shown an embodiment of the present invention in which a plurality of sleeves 20 are assembled in aligned, parallel, planar fashion to form a unitary packet 40 that includes a plurality of card slots 42 for holding a corresponding plurality of cards 10 therein.

I claim:

1. A sleeve for enveloping a store discount card of the type displaying a machine readable code on a surface thereof and having an attachment hole therein, said sleeve being open along an entire periphery thereof, except at a closed fold edge thereof, said closed fold edge having an opening along a portion thereof, said sleeve having a hole therein at a position corresponding to a position of said attachment hole in said card when said card is enveloped in said sleeve, said sleeve being formed of a translucent material that is sufficiently obscure to prevent said machine readable code from being read by a machine when said card is enveloped in said sleeve.

2. A sleeve for enveloping a store discount card as in claim 1, further comprising a narrowed slot within said sleeve proximate said fold edge of said sleeve for more securely retaining said card within said sleeve.

3. A sleeve for enveloping a store discount card as in claim 1, further comprising a pair of facing protrusions on inner surfaces of said sleeve for more securely retaining said card within said sleeve.

4. A sleeve for enveloping a store discount card as in claim 1, wherein said translucent material is sufficiently clear to permit recognition by a user of a store insignia displayed on a surface of said card opposite said surface on which said machine readable code is displayed.

5. A sleeve for enveloping a store discount card as in claim 1, wherein said machine readable code comprises a bar code.

6. A sleeve for enveloping a store discount card as in claim 1, wherein said attachment hole comprises a keychain hole.

7. A sleeve for enveloping a store discount card as in claim 1, wherein said opening in said closed fold edge of said card is generally semicircular in shape.

8. A unitary sleeve packet for enveloping a plurality of store discount cards of the type displaying a machine readable code on one surface thereof and having an attachment hole therein, said sleeve packet having a plurality of card slots adjacent each other, each of which is adapted to receive one of said plurality of cards, said sleeve packet being open along an entire periphery thereof, except at a closed bottom edge thereof, said bottom edge having an opening at a central portion thereof, said sleeve packet having a hole therein at a position corresponding to a position of said attachment hole in each of said plurality of cards when said plurality of cards are enveloped in said sleeve packet.

9. A unitary sleeve packet for enveloping a plurality of store discount cards as in claim 8, wherein said attachment hole comprises a keychain hole.

10. A unitary sleeve packet for enveloping a plurality of store discount cards as in claim 8, wherein said machine readable code comprises a bar code.

11. A unitary sleeve packet for enveloping a plurality of store discount cards as in claim 8, wherein said opening in said bottom edge of said sleeve packet is generally semicircular in shape.

12. A method for storing and accessing a card, the method comprising:

providing a card displaying a machine readable code on a surface thereof and having an attachment hole therein;

providing a sleeve that is open along an entire periphery thereof, except at a closed fold edge thereof, said closed fold edge having an opening along a portion thereof, said sleeve having a hole therein at a position corresponding to a position of said attachment hole in said card when said card is enveloped in said sleeve, said sleeve being formed of a translucent material that is sufficiently obscure to prevent said machine readable code from being read by a machine when said card is enveloped in said sleeve;

inserting said card into said sleeve such that said attachment hole in said card and said hole in said sleeve are in general alignment;

passing an attachment device through both said attachment hole in said card and said hole in said sleeve to thereby retain said card within said sleeve; and pushing said card at said opening in said closed fold edge of said sleeve to partially remove said card from said sleeve to thereby expose said machine readable code on said card for scanning thereof.

13. A method as in claim 12, wherein said opening in said closed fold edge of said sleeve is generally semicircular in shape.

14. A method as in claim 12, wherein said step of passing an attachment device comprises passing a keychain through both said attachment hole in said card and said hole in said sleeve.

15. A method as in claim 12, wherein said attachment hole is positioned proximate a corner of said card.

16. A method as in claim 12, wherein said card comprises a store discount card.

17. A method as in claim 16, wherein said card displays store identification insignia on an opposite side thereof from said side on which said machine readable code is displayed.

* * * * *